US007397231B2

(12) United States Patent
Wang

(10) Patent No.: US 7,397,231 B2
(45) Date of Patent: Jul. 8, 2008

(54) METHOD AND APPARATUS FOR ADJUSTING A REFERENCE

(75) Inventor: Zhao-Jun Wang, San Jose, CA (US)

(73) Assignee: Power Integrations, Inc., san Jose, CA (US)

( * ) Notice: Subject to any disclaimer, the term of this patent is extended or adjusted under 35 U.S.C. 154(b) by 12 days.

(21) Appl. No.: 11/493,504

(22) Filed: Jul. 25, 2006

(65) Prior Publication Data

US 2008/0024105 A1 Jan. 31, 2008

(51) Int. Cl.
*G05F 3/16* (2006.01)
*G05F 3/10* (2006.01)

(52) U.S. Cl. ..... 323/315; 323/314

(58) Field of Classification Search ..... 323/311, 323/312, 313, 314, 315
See application file for complete search history.

(56) References Cited

U.S. PATENT DOCUMENTS 5,187,387 A 2/1993 Kawauchi
5,675,243 A * 10/1997 Kamata ..... 323/313
7,129,683 B2 * 10/2006 Haider et al. ..... 323/273

FOREIGN PATENT DOCUMENTS

DE 4119917 A1 1/1992

OTHER PUBLICATIONS

European Search Report, EP Application No. 07252901.9, Oct. 8, 2007.

* cited by examiner

*Primary Examiner*—Gary L Laxton
(74) *Attorney, Agent, or Firm*—Blakley Sokoloff Taylor & Zafman LLP

(57) ABSTRACT

Examples of a method and apparatus for adjusting a reference. One circuit includes a current divider to divide a current from a current source into a first current and a reference current. The circuit also includes a current mirror coupled to the current divider to receive the first current from the current divider and to receive an adjustment current. The adjustment current is to set the reference current such that the reference current is adjustable between a full value and a fraction of the full value in response to the adjustment current. A change in the reference current and a change in the adjustment current are proportional when the adjustment current is between an upper and a lower threshold value.

17 Claims, 5 Drawing Sheets

METHOD AND APPARATUS FOR ADJUSTING A REFERENCE

BACKGROUND

1. Field of the Disclosure

The present invention relates generally to electrical circuits and, more specifically, the present invention relates to adjusting a reference in an electrical circuit.

2. Background Information

Integrated circuit controllers for switching power supplies use references such as reference voltages and reference currents to detect when internal and external parameters reach particular values. For example, a signal that senses a current in a switch is sometimes compared to a reference in order for a controller to switch off a power switch when the current exceeds a maximum value. Or, a signal proportional to a duty ratio may be compared to a reference so the controller can prevent the duty ratio from exceeding a maximum value. In another example, a signal proportional to an input voltage is compared to a reference to disable operation of a circuit when the input voltage is too high or too low.

Oftentimes, a reference current or reference voltage needs to be adjusted for a particular application or a transient operating condition. In many cases, the reference needs to be changed in response to an external component or a dynamic stimulus. In addition, it is often desirable to adjust the reference between two values. Known techniques, however, for providing an integrated circuit solution can be costly.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Examples of a circuit and method for adjusting a reference such as a reference current or a reference voltage are disclosed herein. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

In one aspect of the present invention, a circuit includes a current divider and a current mirror. In one example, the current divider may divide a current from a current source into a first and a second or reference current. The current mirror may be coupled to receive the first current from the current divider and an adjustment current, in an example. The adjustment current may set the reference current in the circuit and a resistor may be coupled to receive the reference current from the current divider to provide a reference voltage, in the example. Furthermore, in the example, the reference current and a reference voltage may be adjustable between two values, such as, for example, a full value of the reference current or voltage and a fraction of the full value of the reference current or voltage.

Figure 1:
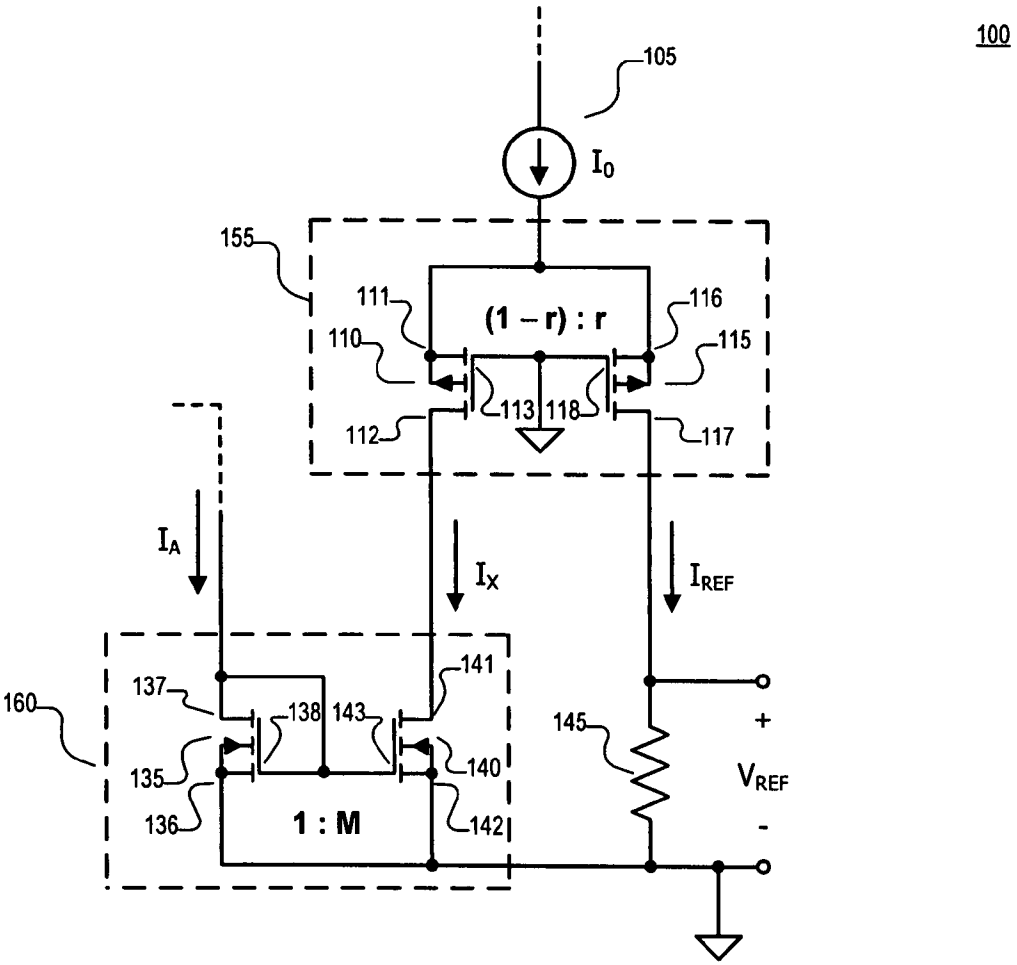
FIG. 1 is a schematic diagram illustrating a circuit according to one embodiment of the present invention.

Shown schematically in FIG. 1 is a circuit 100 including a current divider 155 coupled to a current mirror 160, according to an example. As shown, current divider 155 may include a first transistor 110 including a first, second and third terminal 111, 112 and 113, respectively, and a second transistor 115 including a first, second and third terminal 116, 117 and 118, respectively. In the example, a first terminal 111 of first transistor 110 may be coupled to a first terminal 116 of second transistor 115. In the example a current source 105 may be coupled to first transistor 110 and second transistor 115.

In addition, in the example, a third transistor 135 including a first, second and third terminal 136, 137 and 138, respectively, and a fourth transistor 140 including a first, second and third terminal 141, 142 and 143, respectively, are included in current mirror 160. As illustrated in the example, second terminal 112 of first transistor 110 may be coupled to first terminal 141 of fourth transistor 140, thus coupling current mirror 160 to current divider 155. Note that in the example, transistors 110, 115, 135 and 140 of circuit 100 may include a metal oxide semiconductor field effect transistor (MOSFET). In addition, third transistor 135 and fourth transistor 140 may have respective strengths of the ratio 1:M, in the example.

In operation, current divider 155 may divide a source current or current $I_0$ from a current source 105 into a first current $I_X$ to be output from first transistor 110 and a second current or reference current $I_{REF}$ to be output from second transistor 115. In the example, first and second transistors 110 and 115 may have respective strengths related by a ratio of (1-r):r, where r is less than 1. Accordingly, in the example, a sum of first current $I_X$ and reference current $I_{REF}$ may be substantially equal to a full value of the source current from current source 105 or current $I_0$.

In the example, current mirror 160 may be coupled to current divider 155 to receive first current $I_X$ at first terminal 141 of fourth transistor 140. In the example, current mirror 160 may also be coupled to receive an adjustment current $I_A$ at second terminal 137 of third transistor 135. Thus, in an example, adjustment current $I_A$ may be mirrored to first current $\mathbf{1}_X$. Accordingly, in the example, reference current $I_{REF}$ may be adjusted in response to adjustment current $I_A$. In particular, adjustment current $I_A$ may set reference current $I_{REF}$ to an adjusted value between a full value of reference current $I_{REF}$ and a fraction, r, of the full value of the reference current $I_{REF}$. Furthermore, in the example, a resistor 145 may be coupled to second terminal 117 of second transistor 115 to receive reference current $I_{REF}$ from current divider 155 to provide a reference voltage $V_{REF}$. Note that in various examples, adjustment current $I_A$ may originate either inside or outside an integrated circuit that may contain circuit 100. In one example, the integrated circuit may control a power supply.

Figure 2:
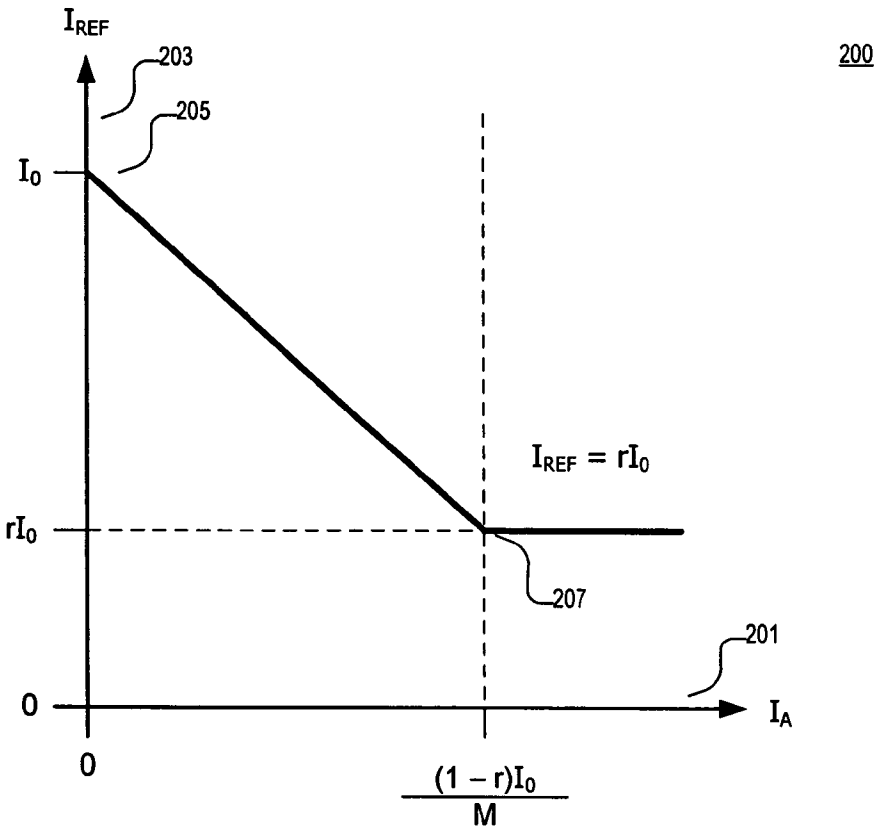
FIG. 2 is a graph associated with the circuit of FIG. 1.

FIG. 2 is a graph 200 depicting the relationship between adjustment current $I_A$, indicated on a horizontal axis 201, and reference current $I_{REF}$, indicated on vertical axis 203. As illustrated in FIG. 2, a change in adjustment current $I_A$ and reference current $I_{REF}$ may be substantially linear or proportional when adjustment current $I_A$ is between an upper and a lower threshold value. Accordingly, in the example, when adjustment current $I_A$ is less than or equal to a lower threshold value such as 0, as in the example of FIG. 2, reference current $I_{REF}$ is substantially equal to current $I_0$, which is a full value 205 of reference current $I_{REF}$. Because the sum of first current $I_X$ and reference current $I_{REF}$ substantially equals current $I_0$, when reference current $I_{REF}$ is at full value 205, first current $I_X$ is equal to 0 (not shown), in the example.

Note that first current $I_X$ is the lesser of either mirrored adjustment current $MI_A$ or current $(1\text{-}r)I_0$, in the example. Accordingly, in the example, because first current $I_X$ may not exceed $(1\text{-}r)I_0$, adjustment current $I_A$ may not reduce reference current $I_{REF}$ to less than a fractional value $rI_0$. Thus, as shown in graph 200, as adjustment current $I_A$ increases, reference current $I_{REF}$ may decrease proportionally until it reaches fractional value $rI_0$ at 207 and first current $I_X$ is equal to current $(1\text{-}r)I_0$. In the example, adjustment current $I_A$ is then greater than or equal to the upper threshold value, $(1\text{-}r)I_0/M$, in the example of FIG. 2. Note also, in the example, resistor 145 may receive reference current $I_{REF}$ to produce a reference voltage $V_{REF}$.

Figure 3:
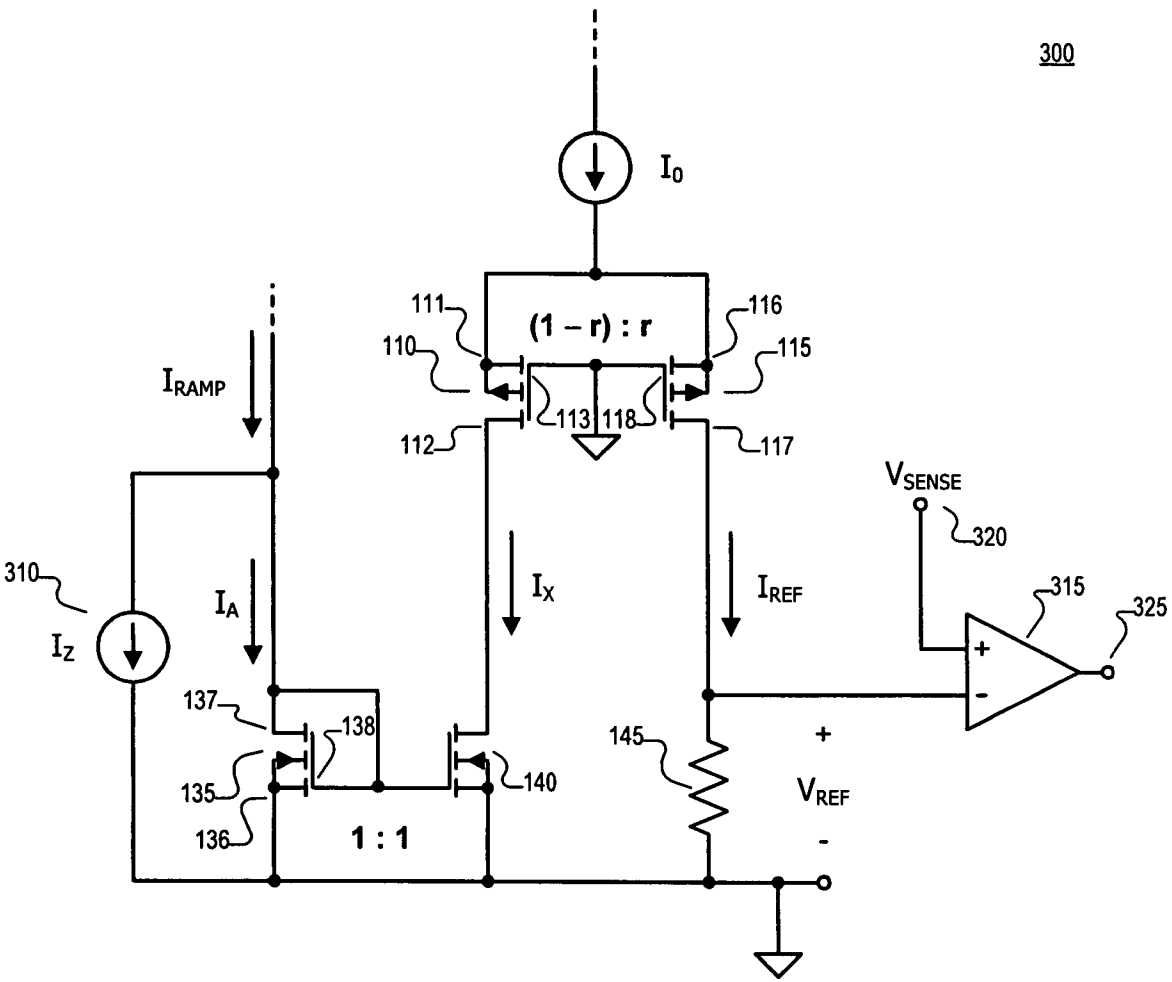
FIG. 3 is a schematic diagram illustrating a circuit according to one embodiment of the present invention.

FIG. 3 illustrates an example circuit 300 associated with an implementation of circuit 100 (FIG. 1), in an example. In the example, circuit 300 may adjust a reference voltage $V_{REF}$ between a full value $V_0$ to a fraction of a full value $rV_0$ as a function of time. Circuit 300 may include a comparator 315 coupled to compare a sensed voltage $V_{SENSE}$ to reference voltage $V_{REF}$ to set an output 325 to a logic high value when a sensed voltage $V_{SENSE}$ exceeds reference voltage $V_{REF}$, in accordance with an example. Circuit 300 may also include an input current source 310 coupled to first and second terminal 136 and 137 of third transistor 135 and coupled to receive an input current $I_{RAMP}$, in the example. In the example, input current source 310 may remove a first threshold current $I_Z$ from input current $I_{RAMP}$ to produce adjustment current $I_A$.

Figure 4:
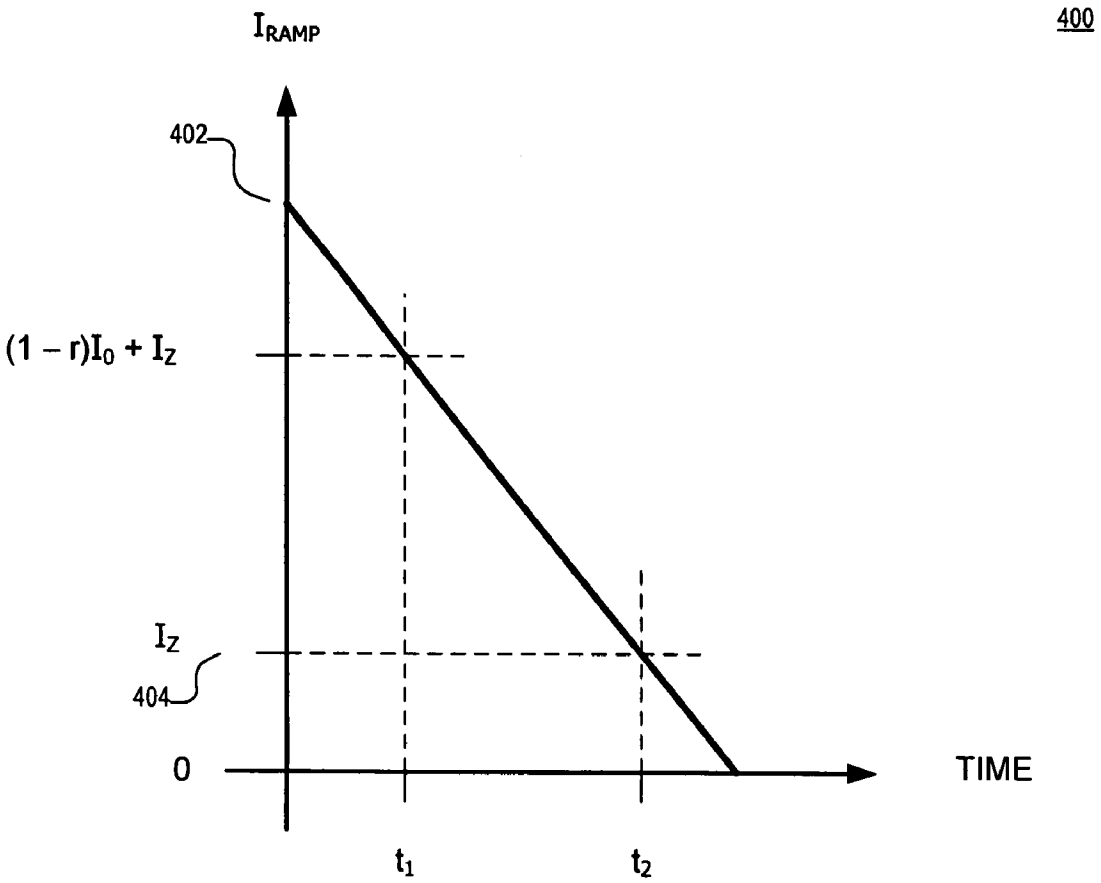
FIG. 4 is a graph associated with the circuit of FIG. 3.

FIG. 4 is a graph 400 of input current $I_{RAMP}$ as a function of time, during operation of circuit 300 of FIG. 3, in an example. As shown, in the example, input current $I_{RAMP}$ may decrease linearly with time from a value 402 that is greater than $(1\text{-}r)I_0$ plus a first threshold current $I_Z$, for times less than $t_1$, to a value that is less than first threshold current $I_Z$, at 404 for times greater than $t_2$. In the example, input current source 310 of FIG. 3 may reduce input current $I_{RAMP}$ by first threshold current $I_Z$ to produce adjustment current $I_A$. In the example of FIG. 3, the strengths of transistors 135 and 140 may be equal, corresponding to M=1 in current mirror 160 of FIG. 1. In various examples, first threshold current $I_Z$ may have a small value such as for example, approximately one microampere, to offset leakage current in $I_{RAMP}$. As a result, the presence of first threshold current $I_Z$ may help to ensure that adjustment current $I_A$ goes to a value of zero.

Figure 5:
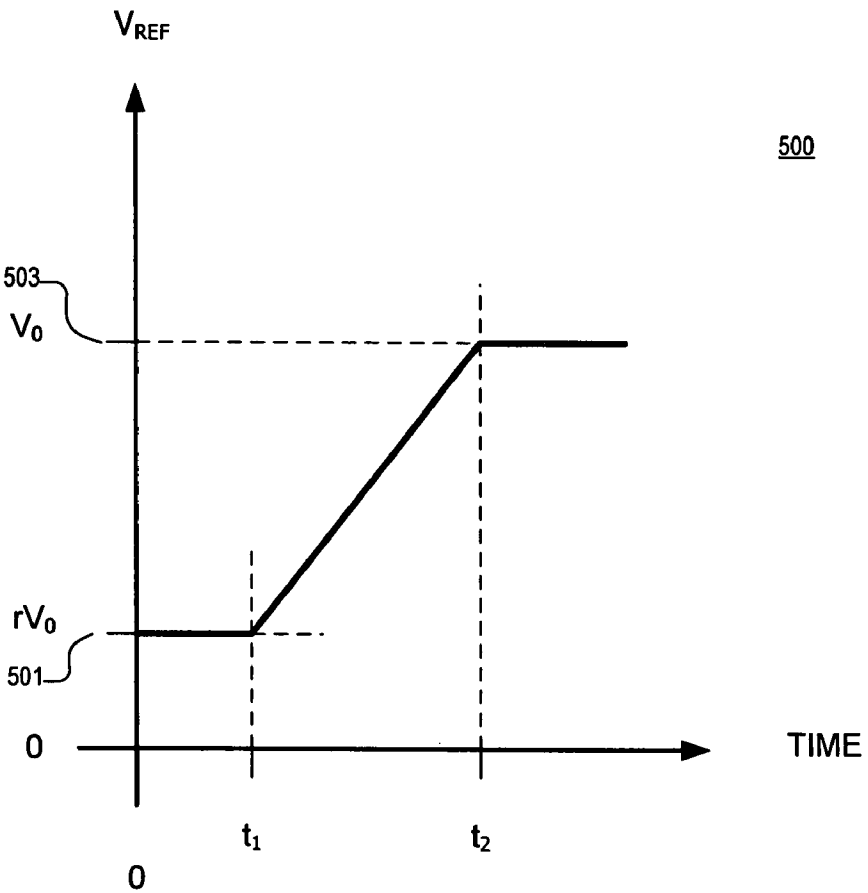
FIG. 5 is a graph associated with the circuit of FIG. 3.

FIG. 5 further illustrates the adjustability of reference voltage $V_{REF}$ between two values, in an example. Graph 500 shows reference voltage $V_{REF}$ of circuit 300 (FIG. 3) as a function of time, in an example. Reference voltage $V_{REF}$ may be generated from reference current $I_{REF}$ and may therefore have a fractional value $rV_0$ at 501 for times less than $t_1$, rise substantially linearly from $rV_0$ to a full value $V_0$ at 503, between time $t_1$ and $t_2$, in the example. In the example, reference voltage $V_{REF}$ may then remain substantially at full value $V_0$ for times greater than $t_2$.

In an example, parameters in the example circuits of FIGS. 1 and 3 may be controlled by design of circuits 100 and 300. In particular, in an example, the values of current $I_0$ of current source 105, first threshold current $I_Z$ z and fractional value r may determine a first and a second value of reference voltage $V_{REF}$ or a full value and a fraction of a full value of reference voltage $V_{REF}$. In various examples, such values may be set with geometric ratios or by trimming on an integrated circuit.

In the foregoing detailed description, the method and apparatus of the present invention has been described with reference to specific exemplary embodiments thereof. It will, however, be evident that various modifications and changes may be made thereto without departing from the broader spirit and scope of the present invention. The present specification and figures are accordingly to be regarded as illustrative rather than restrictive.

What is claimed is:

1. A circuit, comprising:

a current divider to divide a current from a current source into a first current and a reference current; and a current mirror coupled to the current divider to receive the first current from the current divider and to receive an adjustment current, the adjustment current to set the reference current such that the reference current is adjustable between a full value and a fraction of the full value in response to the adjustment current, wherein a change in the reference current and a change in the adjustment current are proportional when the adjustment current is between an upper and a lower threshold value.

2. The circuit of claim 1 further comprising a resistor coupled to receive the reference current from the current divider to provide a reference voltage.

3. The circuit of claim 1 wherein the current divider includes a first transistor and a second transistor, wherein a first terminal of the first transistor is coupled to a first terminal of the second transistor.

4. The circuit of claim 3 wherein the transistors in the current divider include metal oxide semiconductor field effect transistors (MOSFETs).

5. The circuit of claim 3 wherein the first and the second transistor have respective strengths related by a ratio of a first number to a second number wherein the sum of the first number and the second number is substantially equal to 1.

6. The circuit of claim 1 wherein the first current is the current from the current source multiplied by a number less than 1 when the adjustment current is greater than the upper threshold value.

7. The circuit of claim 1 wherein the value of the first current is zero when a value of the adjustment current is less than the lower threshold value.

8. The circuit of claim 1 wherein the current from the current source is the sum of the first current and the reference current.

9. The circuit of claim 1 wherein the current mirror includes a third transistor and a fourth transistor having strengths related by a ratio 1:M, wherein M is a relative strength of the fourth transistor to the third transistor.

10. The circuit of claim 9 where the third and the fourth transistors include metal oxide semiconductor field effect transistors (MOSFETs).

11. The circuit of claim 9 wherein the third transistor is coupled to receive the adjustment current.

12. The circuit of claim 1 wherein the circuit is included in an integrated circuit.

13. The circuit of claim 12 wherein the integrated circuit is coupled to control a power supply.

14. A method, comprising:

dividing a source current into a first current and a second current such that a sum of the first and the second current is substantially equal to the source current;

mirroring an adjustment current into the first current; and adjusting the second current in response to the adjustment current such that the second current is adjustable between a full value and a fraction of the full value in response to the adjustment current, wherein a change in the second current and a change in the adjustment current are proportional when the adjustment current is between an upper and a lower threshold value.

15. The method of claim 14 further comprising generating a reference voltage from the second current.

16. The method of claim 14 further comprising receiving the source current from a current source.

17. The method of claim 14 further comprising reducing an input current by a first threshold current to produce the adjustment current.

* * * * *